United States Patent [19]

Kühl

[11] 4,195,712

[45] Apr. 1, 1980

[54] CONTROL SYSTEM FOR A PLURALITY OF ELEVATORS

[76] Inventor: Eberhard Kühl, Riedstrasse 16, 6500 Mainz, Fed. Rep. of Germany

[21] Appl. No.: 898,181

[22] Filed: Apr. 20, 1978

[30] Foreign Application Priority Data

Apr. 25, 1977 [DE] Fed. Rep. of Germany ..... 2718300

[51] Int. Cl.[2] ..... B66B 3/00

[52] U.S. Cl. ..... 187/29 R; 340/19 R

[58] Field of Search ..... 187/29; 340/19, 20

[56] References Cited

U.S. PATENT DOCUMENTS

| | | | |
|---|---|---|---|
| 2,066,908 | 1/1937 | Bouton et al. | 340/19 |
| 2,100,736 | 11/1937 | Eames | 187/29 |
| 2,240,044 | 4/1941 | Kramer | 340/19 |
| 2,742,979 | 4/1956 | Santini et al. | 187/29 |
| 2,826,751 | 3/1958 | Thurston et al. | 340/19 |

*Primary Examiner*—J. V. Truhe
*Assistant Examiner*—W. E. Duncanson, Jr.
*Attorney, Agent, or Firm*—Max Fogiel

[57] ABSTRACT

A control system for use in conjunction with several elevators which are located close to one another and are controlled independently. The elevators are provided with a call button for each elevator door on each floor. After actuating one call button, all other call buttons on that same floor are blocked from being operative for a predetermined time interval. Each call button is constructed as a parallel contact and is connected, on the one hand, by a time relay and, on the other hand, directly to an auxiliary relay wired as an interrupter. From there, the call button is connected by a call line to associated elevator controls. The call buttons may be constructed as conventional push button switches, and a control unit in the form of a common interrupter may be installed in the call line together with a time lag relay, an auxiliary relay and an OR-circuit. The arrangement may be such that after actuating one "up" button all other "up" buttons are blocked for a predetermined time interval. Similarly, after actuating one "down" button, all other "down" buttons on the same floor are blocked for the predetermined time interval.

5 Claims, 10 Drawing Figures

CONTROL SYSTEM FOR A PLURALITY OF ELEVATORS

BACKGROUND OF THE INVENTION

The present invention relates to a control system for a plurality of elevators which are close together and are controlled independently of one another, with a call button assigned to each elevator on each floor.

In large buildings with high passenger traffic, there frequently are adjacent elevators which are not connected by a central control system. It frequently happens that almost all individuals who wish to procure quick service, push all call buttons of all elevators installed on one floor and cause a large number of unnecessary trips of the elevators. In order to remedy this shortcoming, it is already known in the art how to use central control systems for elevators; however, they are relatively expensive to purchase and to maintain.

It is, therefore, an object of the present invention to prevent in a control system, as described above, the simultaneous call for several elevators from one floor by one or several persons within a predetermined time interval at minimum cost.

Another object of the present invention is to provide an arrangement of the foregoing character which is substantially simple in construction and may be readily maintained in service.

A further object of the present invention is to provide an arrangement, as described, which has a substantially long operating life.

SUMMARY OF THE INVENTION

The objects of the present invention are achieved by providing that after actuating one call button, all other call buttons on the same floor are blocked for a predetermined time interval. In a further embodiment of the invention, any call button, constructed as a parallel contact, is connected via a time-lag relay, on the one hand, and, on the other hand, directly to an auxiliary circuit wired as an interrupter from which a call line leads to the associated elevator controls.

With another embodiment of the present invention, each call button is divided into an "up" button and a "down" button; after actuating one "up" button, all other "up" buttons are blocked, and after actuating one "down" button, all "down" buttons are blocked for a predetermined time interval on the same floor.

In another embodiment of the invention, in order to provide the user with information about the nearest available elevator, each call button, constructed as a parallel contact, is connected via an electronic control to an auxiliary relay, installed in the associated call line and wired as interrupter, and each call button has a lamp to indicate the elevator closest to that floor, with the lamps being energized via the electronic control to determine the location of the elevators.

In another embodiment of the invention, each up and down button, constructed as a parallel contact, is connected via an electronic control to an auxiliary relay, installed in the associated call line and wired as an interrupter, and each up and down button has a lamp to indicate the elevator closest to that floor. These lamps are energized via the electronic control to determine the location of the elevators.

The expense for installing the control system in accordance with the present invention is much lower than that for elevator systems with a central control unit, since only the installation of several relays is required in order to prevent the simultaneous starting of several elevators and hence a large number of unnecessary trips.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
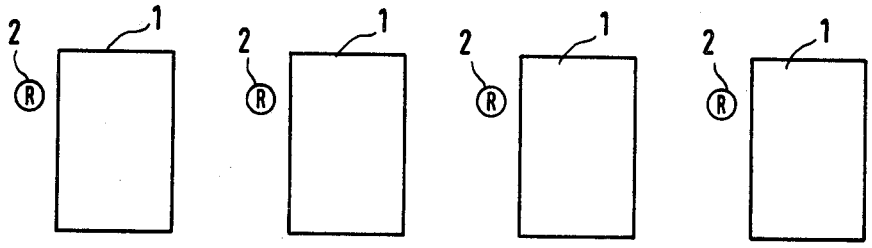
FIG. 1 shows a schematic diagram of the elevator doors with associated call buttons of several adjacent elevators on one floor.
Figure 2:
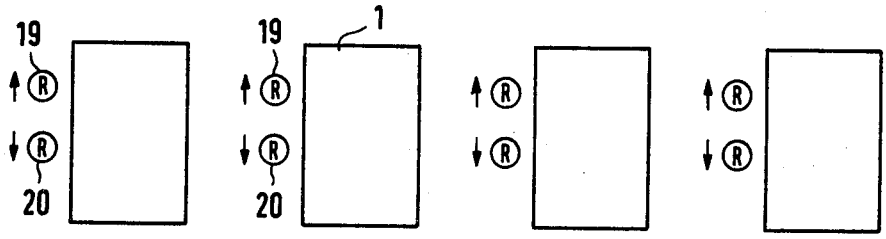
FIG. 2 shows a schematic diagram of the elevators doors with call buttons divided into up and down buttons of several adjacent elevators on one floor.
Figure 3:
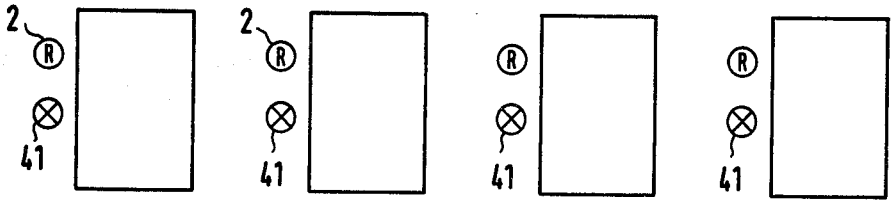
FIG. 3 shows a schematic diagram of the elevator doors with associated call buttons with light display of several adjacent elevators on one floor.
Figure 4:
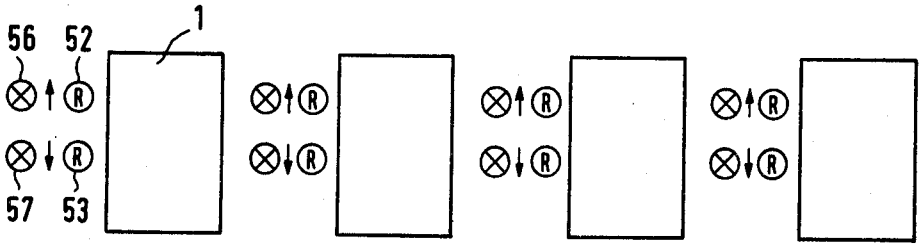
FIG. 4 shows a schematic diagram of the elevator doors with call buttons divided into up and down buttons, and associated light display of several adjacent elevators on one floor.
Figure 1A:
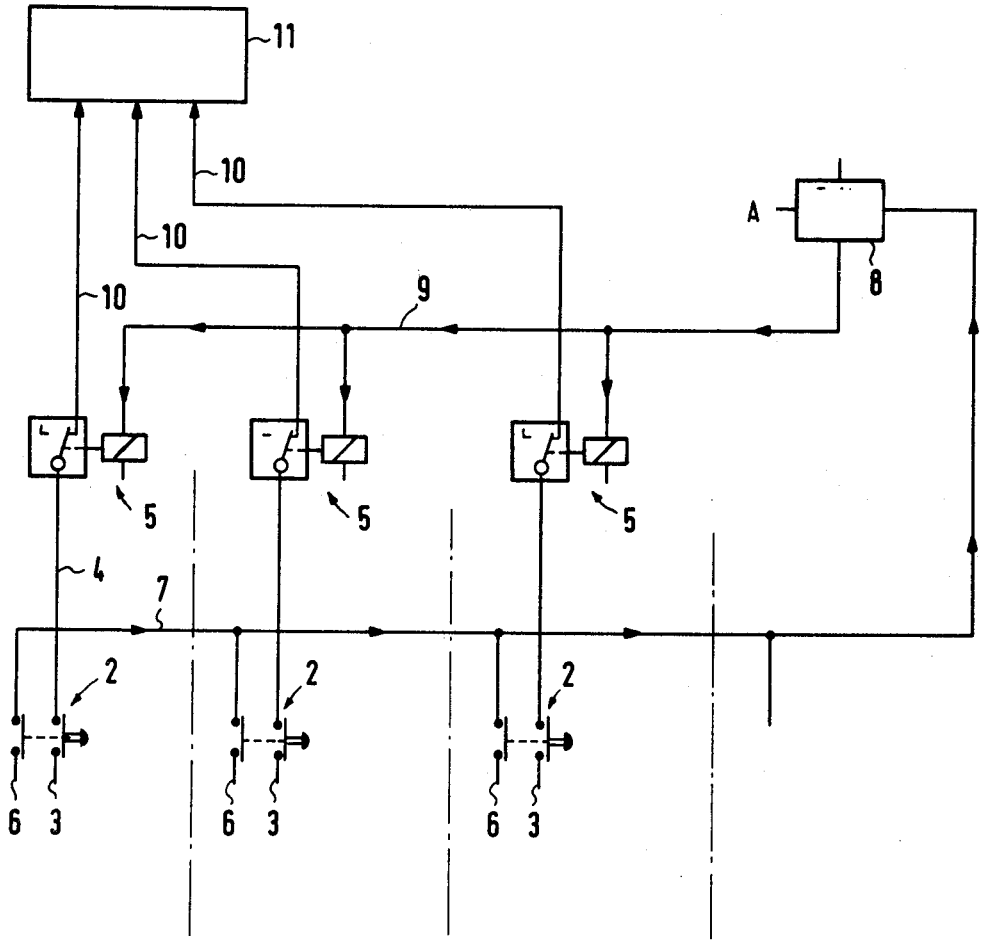
FIG. 1*a* shows a circuit diagram of the call buttons according to FIG. 1.

The call buttons 2 associated with the individual elevator doors 1 are parallel contacts whose one contact 3 is connected via line 4 to an auxiliary relay 5, wired as an interrupter, and whose contact 6 leads via line 7 to a time-lag relay 8 with adjustable make time and drop-out time delay. Time lag relay 8 is connected via line 9 to the individual auxiliary relays 5 from which call lines 10 are connected to the associated elevator controls 11.

When a call button 2 is actuated, time-lag relay 8 is energized; this makes all auxiliary relays 5 which interrupt all call lines 10 on that floor for a drop-out delay set on the time-lag relay. After the drop-out time of time-lag relay 5, the call buttons 2 are released again for the next command. The make time of time-lag relay 8 must be set so that the first command (call for elevator) of that particular floor is safely received by the associated elevator control. This circuit is installed without interfering with the elevator controls 11 of the individual elevators on each floor, with the number of elevators not restricted, of course.

Figure 1B:
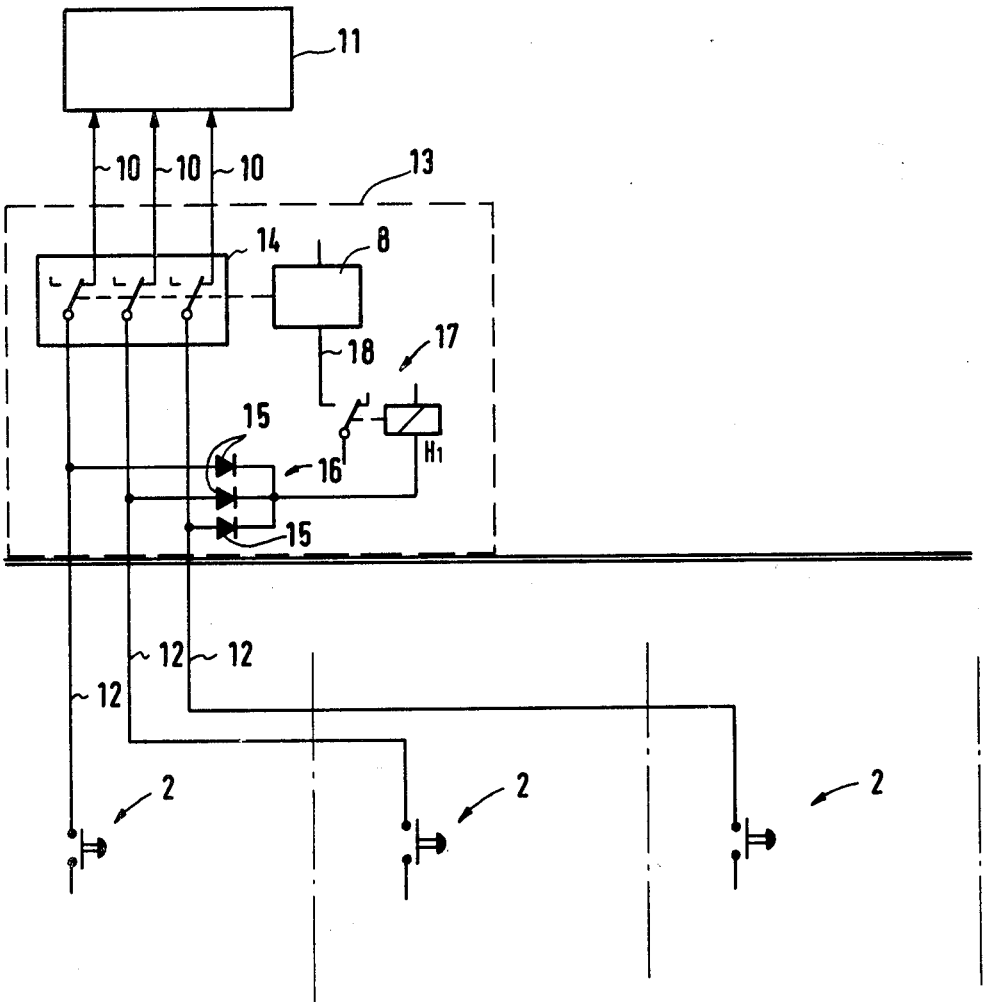
FIG. 1*b* shows an alternative circuit diagram of the call buttons according to FIG. 1.

In the construction of FIG. 1*b*, the call buttons 2 are connected via associated lines 12 with a control unit 13 located physically close to the elevator controls 11. From lines 12, which in the control unit 13 lead to a common interrupter 14 of call lines 10, there emanates in the control unit 13 or OR circuit 16, made up of diodes 15, and leads to an auxiliary relay 17 for the galvanic separation. Auxiliary relay 17 is connected via line 18 to time-lag relay 8 which energizes the common interrupter 14 of call lines 10. Hereto, upon actuation of one of the call buttons 2, after a certain make-time of time-lag relay 8, an additional elevator call is prevented during the time of drop-out delay set on the time-lag relay 8.

Figure 2A:
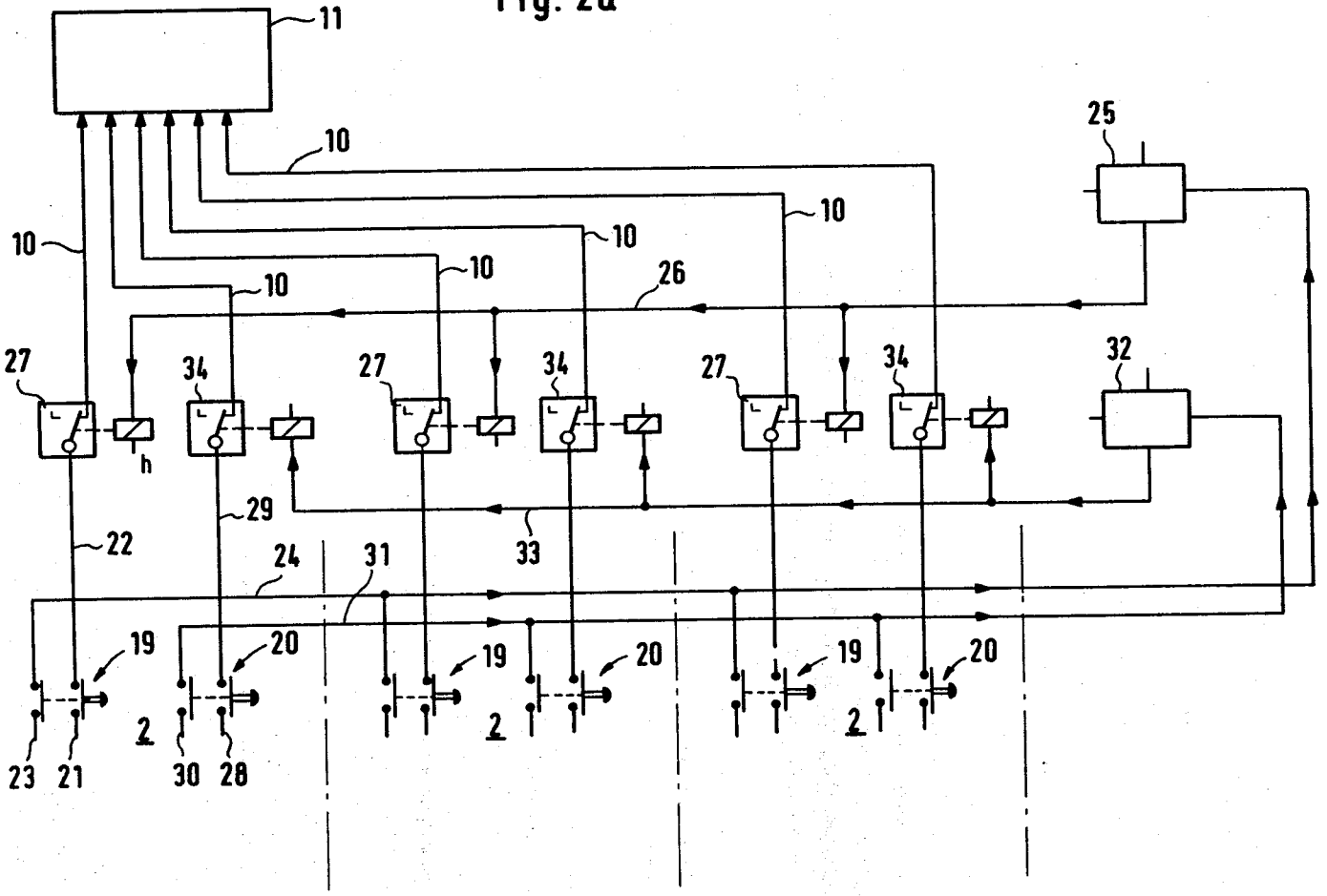
FIG. 2*a* shows a circuit diagram of the up and down buttons according to FIG. 2.

In the circuit diagram of FIG. 2*a*, the call buttons 2 are divided into an "up" button 19 and a "down" button 20, with each "up" button 19 and "down" button 20 forming a parallel contact whose one contact 21 is connected directly via line 22 and whose other contact 23 leads via line 24, the time-lag relay 25 and line 26, to the associated auxiliary relays 27, which are wired as interrupters of all lines 10. The "down" buttons 20 are also connected, either directly via their contact 28 and line 29, or via their contact 30, line 31, the time-lag relay 32 with adjustable make- and drop-out delays and line 33 to auxiliary relays 34 wired as interrupters for the associated call lines 10. The call lines 10 lead to the elevator controls 11. When actuating an "up" button 19 or a "down" button 20, all other "up" and "down" buttons are blocked for a certain interval via the time-lag relay 25 or 32.

Figure 2B:
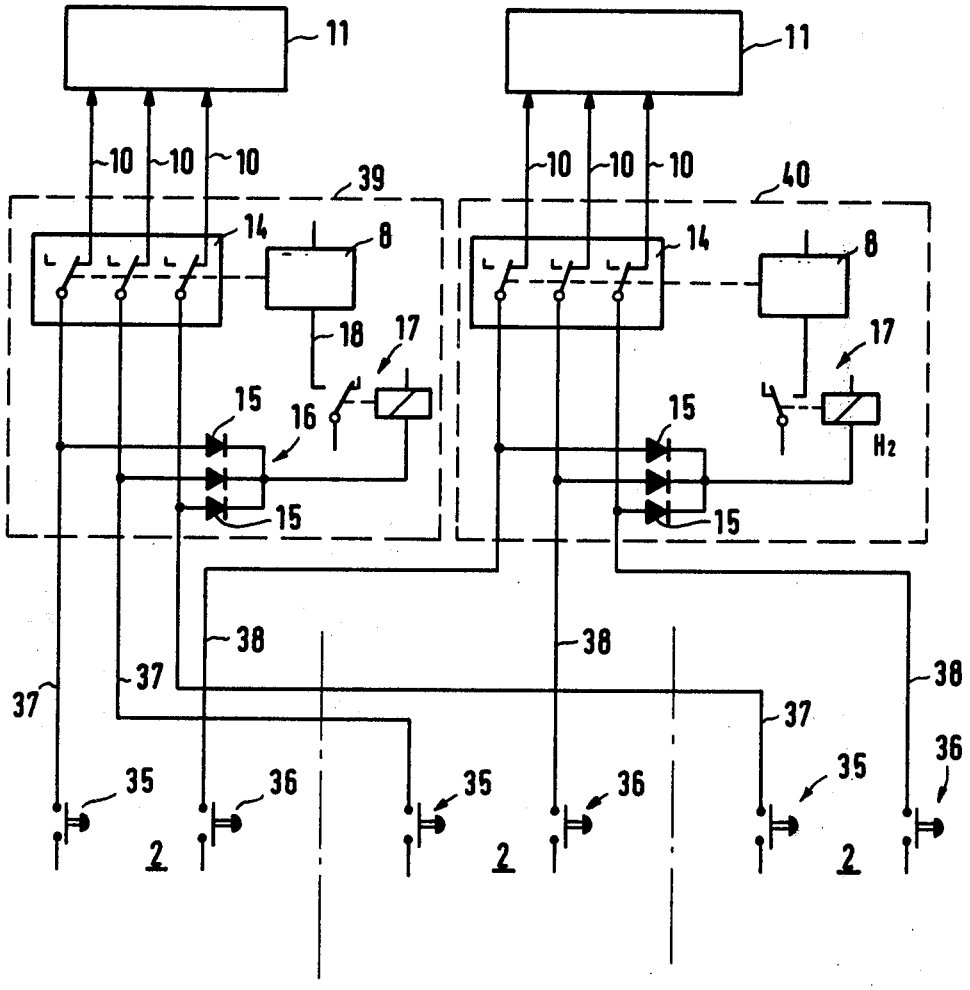
FIG. 2*b* shows an alternative circuit diagram of the up and down buttons according to FIG. 2.

According to the circuit diagram of FIG. 2*b*, the call buttons 2 are divided into an "up" button 35 and a "down" button 36 from which a line 37 or 38, respectively, leads to a separate control unit 39 or 40, respectively, assigned to the elevator controls 11. Each control unit 39, 40 is constructed like the control unit 13 of FIG. 1*b*, so that, after actuating one "up" button 35, all other "up" buttons, and after actuating one "down" button 36, all "down" buttons are blocked for a certain time interval.

Figure 3A:
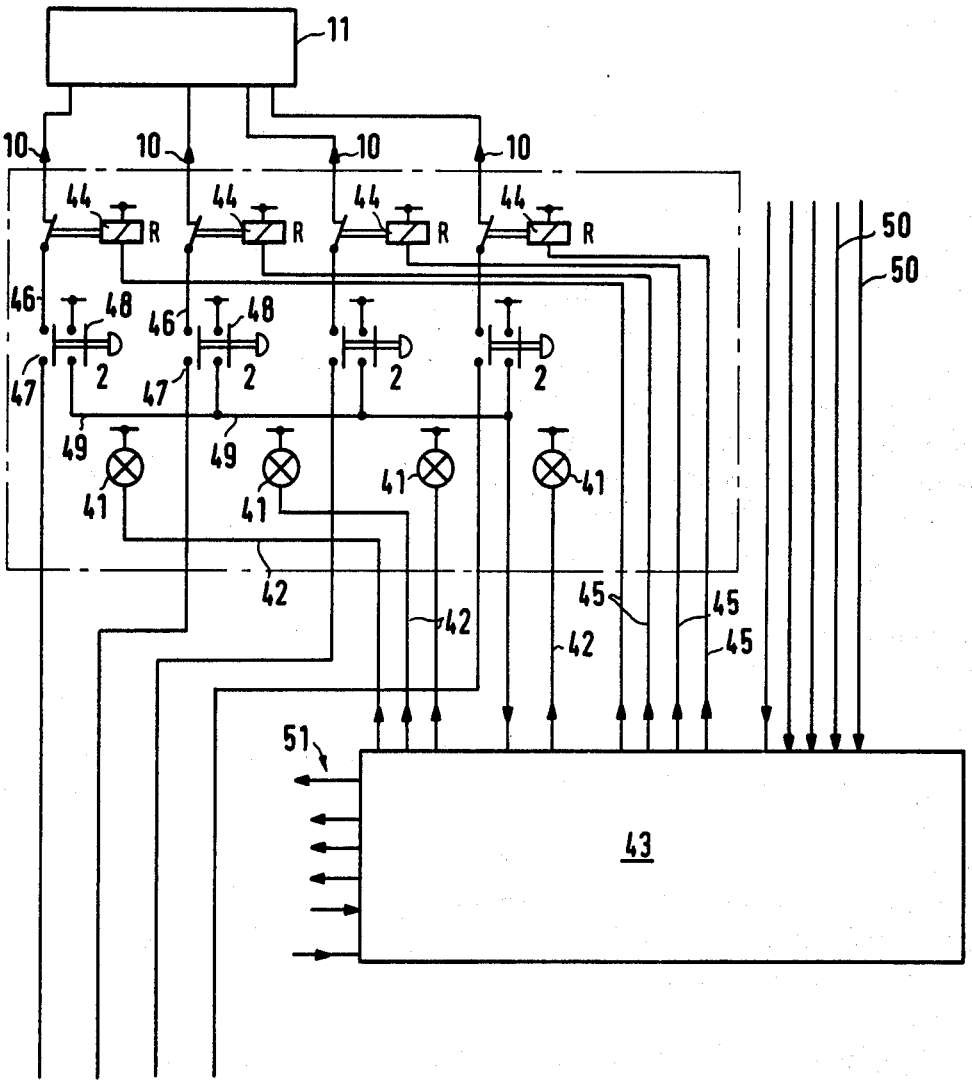
FIG. 3*a* shows a circuit diagram of the call buttons with light display according to FIG. 3.

In the circuit diagram of FIG. 3*a*, to inform the elevator user, the call buttons 2, constructed as parallel contacts, have lamps 41 or some other signal elements to display the elevator nearest to the particular floor. Each lamp 41 is connected via a line 42 to an electronic control unit 43, associated with the elevator controls 11, for locating the position of the elevators. On each floor, each call line 10 has an auxiliary relay 44 wired as interrupter which is energized via line 45 in accordance with the make- and drop-out delay set in the electronic control system. Auxiliary relay 44 is connected via line 46 with one contact 47 of the parallel contact of call button 2. The other contact 48 of the parallel contact of call button 2 leads via line 49 to the electronic control system 43 to which lines 50 for the floor displays are connected. Also, the connections 51 to the other floors emanate from this electronic control system. The lamp 41 whose associate elevator is closest to the floor is lit. If a call button 2 is pressed, a standard call goes to elevator control 11 and a display signal is applied to the electronic control system 43 which is wired as a collective report system for all call buttons. The electronic control system 43, after the set brief delay interval, energizes the auxiliary relays 44, for preventing further calls. After a predetermined delay interval, adjustable via the electronic control system, the call buttons are released again.

Figure 4A:
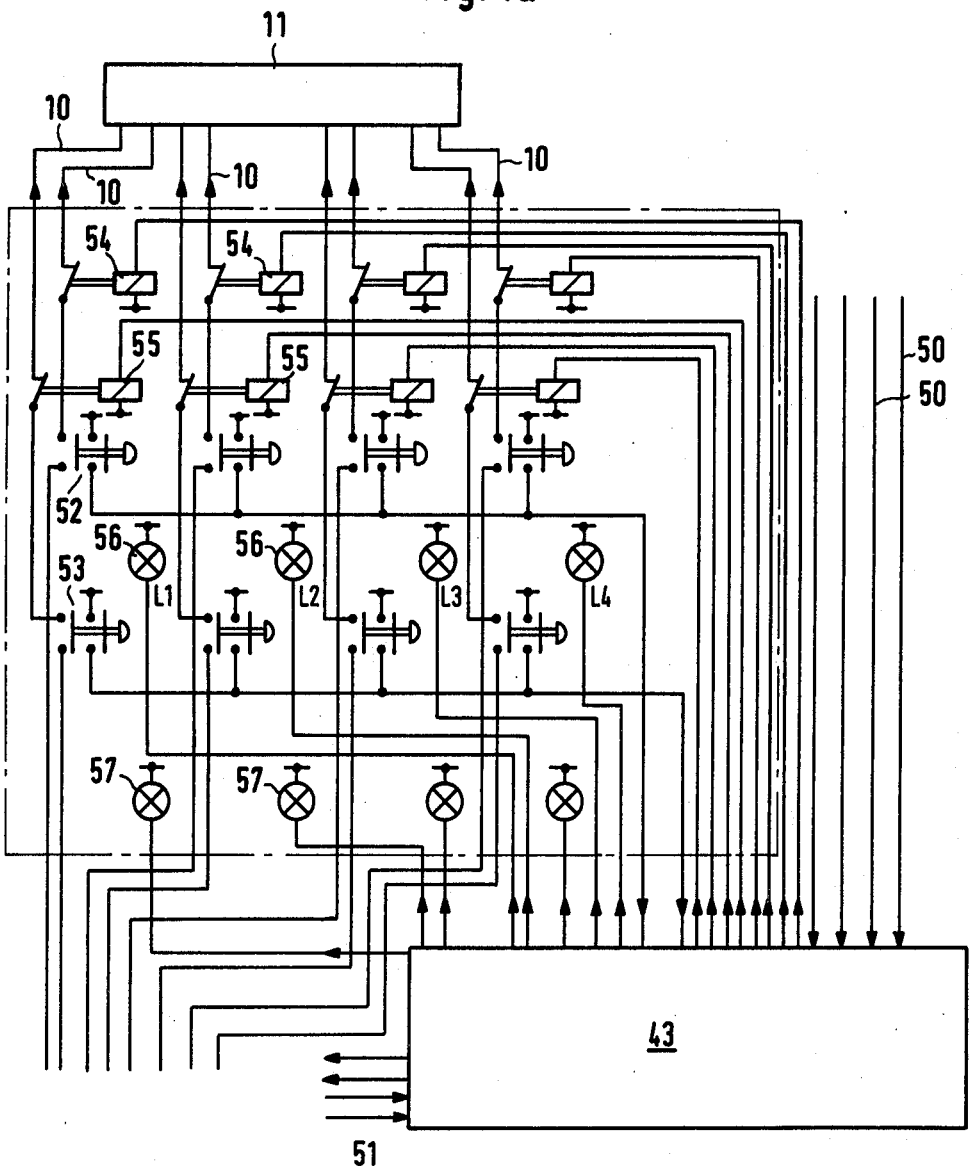
FIG. 4*a* shows a circuit diagram of the up and down buttons with associated light display according to FIG. 4.

In the embodiment of FIG. 4*a*, the call buttons 2 are divided into an "up" button 52 and a "down" button 53, with the "up" and "down" buttons according to circuit diagram 3*a* having auxiliary relays 54 or 55 and lamps 56 or 57 to display the elevator nearest to the floor; these auxiliary relays are controlled via the electronic control system 43. One of the lamps 56 for "elevator going up" and one of lamps 57 for "elevator going down" is always lit. To prevent all lamps from being continually turned off and on by the continuous quick passage of ascending and descending elevators, the electronic control system 43 is laid out in such a way that another lamp can only be lit at 5 second intervals. Upon actuation of an "up" or a "down" button, all other "up" and "down" buttons are blocked via the auxiliary relays 54 or 55 energized by the electronic control system.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What I claim is:

1. A control system for a plurality of elevators located close to one another and controlled independently, comprising: call buttons, one for each elevator door on each floor; and means for preventing said call buttons from being operative for a predetermined time interval after any one of said call buttons has been actuated; a time-delay relay an an auxiliary relay connected as interrupter; elevator controls associated with said call buttons; a call line; each call button comprising a parallel contact connected, on one hand, via said time relay and, on the other hand, directly to said auxiliary relay to the associated elevator control by said call line.

2. A control system for a plurality of elevators located close to one another and controlled independently, comprising: call buttons, one for each elevator door on each floor; and means for preventing said call buttons from being operative for a predetermined time interval after any one of said call buttons has been actuated; an elevator control associated with each call button; a control unit for the associated elevator control; each call button comprising a push button switch connected to said control unit; said control unit comprising an interrupter in a call line and connected with a time delay relay, an auxiliary relay and an OR-circuit.

3. A control system for a plurality of elevators located close to one another and controlled independently, comprising: call buttons, one for each elevator door on each floor; and means for preventing said call buttons from being operative for a predetermined time interval after any one of said call buttons has been actuated; each of said call buttons being divided into an "up" button and a "down" button, after actuating one "up" button all other "up" buttons being inoperative for a predetermined time interval, and after actuating one "down" button all other "down" buttons on the same floor being inoperative for the predetermined time interval; an elevator control associated with each call button having parallel contacts; a time delay relay connected to one of said parallel contacts; an auxiliary relay connected as interrupter means connected to another one of said parallel contacts; and a call line connected between said auxiliary relay and said elevator control unit.

4. A control system for a plurality of elevators located close to one another and controlled independently, comprising: call buttons, one for each elevator door on each floor; and means for preventing said call buttons from being operative for a predetermined time interval after any one of said call buttons has been actuated; said means for preventing said call buttons from being operative comprising auxiliary relays associated with said call buttons; time delay relays connected to said auxiliary relays and having adjustable delay times for actuating said auxiliary relays.

5. A control system for a plurality of elevators located close to one another and controlled independently, comprising: call buttons, one for each elevator door on each floor; and means for preventing said call buttons from being operative for a predetermined time interval after any one of said call buttons has been actuated; electronic controls means for determining the location of an elevator with respect to floors passed by said elevator; each call button having lamp means connected to said electronic control means for indicating the elevator closest to the floor associated with the call button by being energized by said electronic control means; elevator control means; an auxiliary relay connected to said call button; and a call line connected between said auxiliary relay and said elevator control means, said auxiliary relay comprising interrupter means for interrupting signal flow from said call button to said elevator control means; said auxiliary relays being actuated by said electronic control means, said electronic control means having adjustable time delay means for actuating said auxiliary relays for adjustable time intervals.

* * * * *